US005216939A

United States Patent [19]

Swenson

[11] Patent Number: 5,216,939

[45] Date of Patent: Jun. 8, 1993

[54] INTERCHANGEABLE TIP AND/OR WEIGHT HAMMER

[76] Inventor: William B. Swenson, P.O. Box 1853, Joshua Tree, Calif. 92252

[21] Appl. No.: 955,438

[22] Filed: Oct. 2, 1992

[51] Int. Cl.[5] ..... B25D 1/02

[52] U.S. Cl. ..... 81/25; 81/20

[58] Field of Search ..... 81/20, 25

[56] References Cited

U.S. PATENT DOCUMENTS 2,332,384 10/1943 Koster ..... 81/25 X
3,618,678 11/1971 Smith ..... 81/25 X
3,948,301 4/1976 Hays ..... 81/25 X
4,039,012 8/1977 Cook ..... 81/25 X

*Primary Examiner*—James G. Smith

[57] ABSTRACT

A hammer head with an interchangeable tip and a hollow interior housing within which various weights can be inserted and held tightly in place. The tip of the hammer head is easily removed and changed using a slotted keyhole entry. The internal weight is held in place within the interior of the head and tip. A retainer ring rides in grooves within the head housing effectively holding the tip in place.

2 Claims, 3 Drawing Sheets

INTERCHANGEABLE TIP AND/OR WEIGHT HAMMER

BACKGROUND OF THE INVENTION

This invention relates to hammers and specifically to an Interchangeable Tip and/or Weight Hammer.

During the process of a patent search, no prior art was found dealing with my unique invention. However, in several tool encyclopedias a soft-faced hammer was discovered. The process of removal is by means of a socketed head into which soft bases are screwed. This soft-faced hammer is limited only to the exchanging of special shaped faces for shaping work and is not designed to drive nails. Furthermore, this soft-faced hammer would be damaged if used to strike a sharp edge or a corner. Therefore I find it irrelevant to my invention.

The ability to interchange various tips and/or weights in my invention eliminates the need for more than one hammer. Carpenters will not need to climb up and down ladders with several different-weighted and several different-faced hammers to accomplish their tasks. The ability to easily remove the weight lightens the stress on the user and prolongs his working stamina. Construction workers driving nails above their heads while in awkward positions will thankfully lighten their work load by simply removing the weight, which can be placed in their tool pouch or hung on their tool ring. This is accomplished by drilling a small hole in either the tip or weight or both. They will also be able to exchange a checkered-faced tip to a finishing-faced tip in a matter of seconds. They will be proud to display their new and efficient tool. They now have all their old hammers in one. This will revolutionize the hammer industry and increase productivity. Craftsmen will further enjoy their work while using my invention as I have designed these tools to remain perfectly balanced with or without the interchangeable weight. My invention is not limited to the claw hammer but can be incorporated to any of the tools in the hammer family.

With my invention, right or left-handed persons can easily remove the interchangeable tip by using the key slot conveniently located at the topside poll of the hammer. This key slot is designed to open by using a prying tool such as a nail or perhaps a screwdriver, all depending on the hammer in use. Whatever the situation, the worker always has a handy means of removing the interchangeable tip or the interchangeable weight.

It is quite obvious the reason I invented this multi-faceted hammer, furthermore, the need for such a hammer is limitless. All persons, whether the housewife or the skilled craftsmen, will need a hammer, a new Interchangeable Tip and/or Weight Hammer, which is claimed under the Document Disclosure Program assigned as #307545.

SUMMARY OF THE INVENTION

Accordingly several objects of my invention are as follows:

The interchangeable tip of my invention is easily removed by using the slotted keyhole. This allows the replacement of the tip when worn thereby reducing the cost of purchasing a new hammer. Further advantages include the ability to exchange the tip for different surfaced tips relating to different results desired thus eliminating the need for special-purpose hammers.

The weight naturally seats itself into the interchangeable tip. The removal of said weight allows the reduction in the overall weight of the hammer thus providing the user the advantage of lessening his work load and the need of carrying more than one hammer for this purpose. The ability to exchange weights prevents the need of using several weighted hammers for driving different nails into different surfaces. Therefore, different weights made from a variety of materials or combination of materials, may be easily installed granting the user several different weight hammers, all in one, according to his preference.

The retainer ring rides comfortably in the groove of the receiving housing of the hammer. This ring efficiently holds the interchangeable tip in place. When necessary, it can quickly and easily snap out for replacement thus furthering the life of the hammer.

The receiving housing of the hammer features a rounded relief located on the inner edge of the outside circumference. This prevents the tip from siezing in the event of possible mushrooming of the outside circumference. To prevent mushrooming from occurring, the steel should be either "case hardened", "liquid carbonized", or "through hardened".

Further objects and advantages of my invention will become apparent from a consideration of the drawings and ensuing description thereof.

BRIEF DESCRIPTION OF THE INVENTION

DETAILED DESCRIPTION OF A PREFERRED EMBODIMENT

The Interchangeable Tip And/Or Weight Hammer is designed for any species of hammer. A variety of materials or combination of materials may be incorporated in my invention to provide a variety of functions in one hammer.

Figure 1:
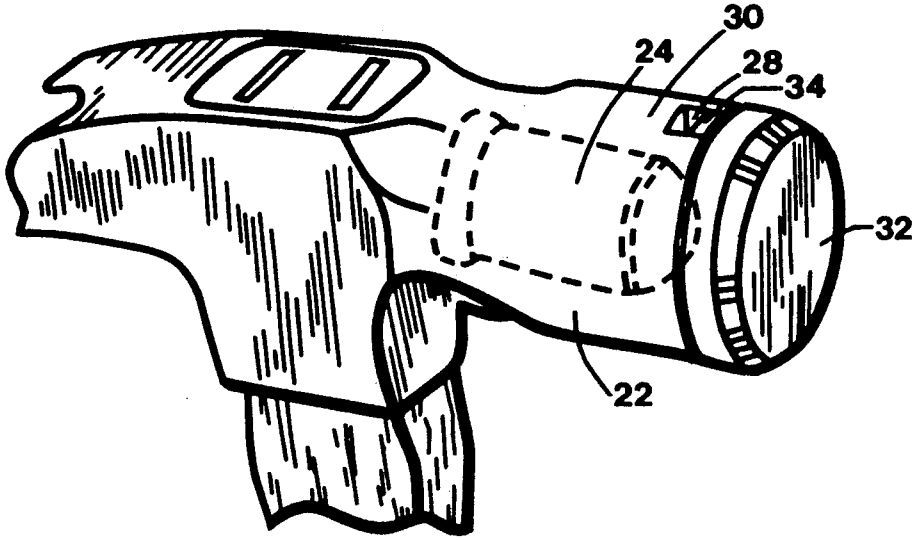
FIG. 1 is an isometric, fragmented view with the enclosed receiving housing in ghost.
Figure 4:
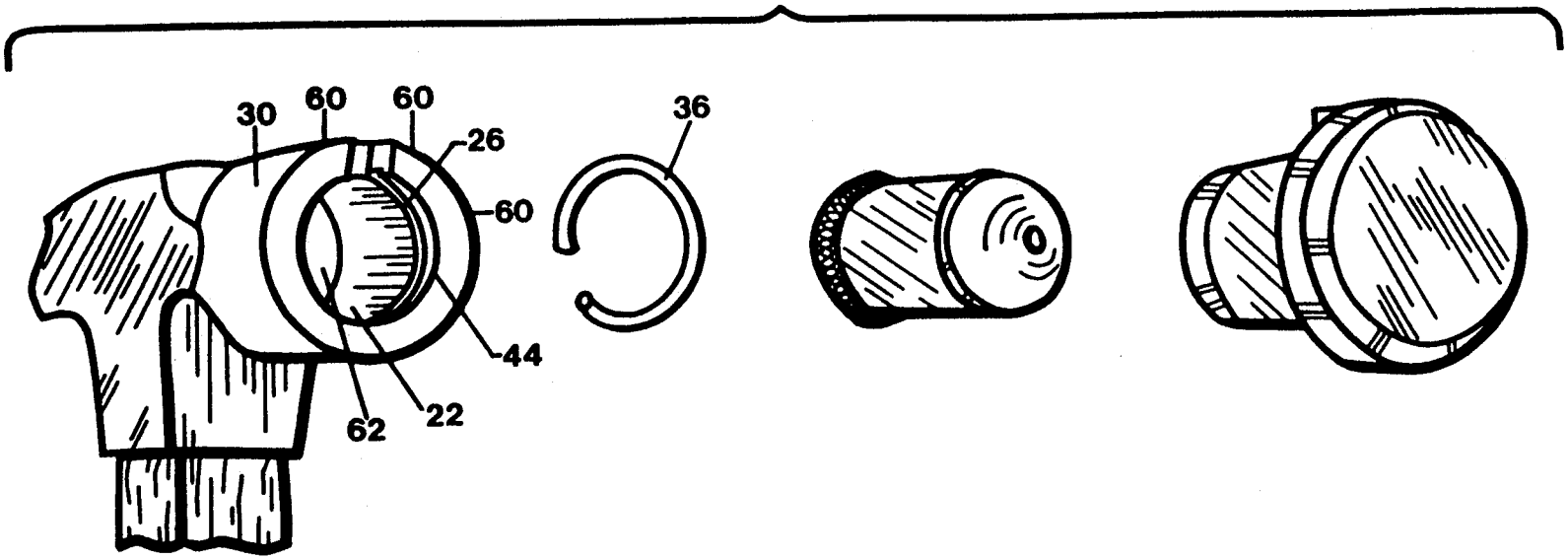
FIG. 4 is an isometric exploded view of my invention.
Figure 10:
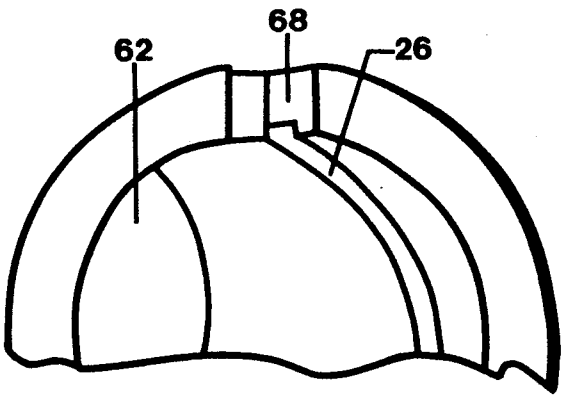
FIG. 10 is the section taken through FIG. 4 by section lines 60.

FIG. 1 of the drawings clearly demonstrates the placement of the interchangeable weight, FIG. 1-24, within the receiving housing, FIG. 1-22, of the hammer. The receiving housing, FIG. 4-22, itself is bored out and reamed having a flat bottom, FIG. 4-62, where the weight as such "bottoms out" when in place. A groove, FIG. 4-26, to hold the retainer ring, FIG. 4-36, is cut within the inner circumference of the receiving housing, FIG. 4-22, by using a lathe. The key slot, FIG. 1-28 and FIG. 10, is a perpendicular precision-cut from the poll, FIG. 1-30, of the hammer. Notice in FIG. 10 that the sides of the key slot are cut, FIG. 10-68, to accommodate the groove for the retainer ring, FIG. 4-26. FIG. 7 clearly illustrates the key slot, FIG. 7-28 and FIG. 10, firmly interlocking with the key of the tip, FIG. 7-34 and FIG. 9, as the retainer ring, FIG. 7-36, engages and locks into the tapered groove, FIG. 2-38 and FIG. 8, of the interchangeable tip, FIG. 2.

Figure 2:
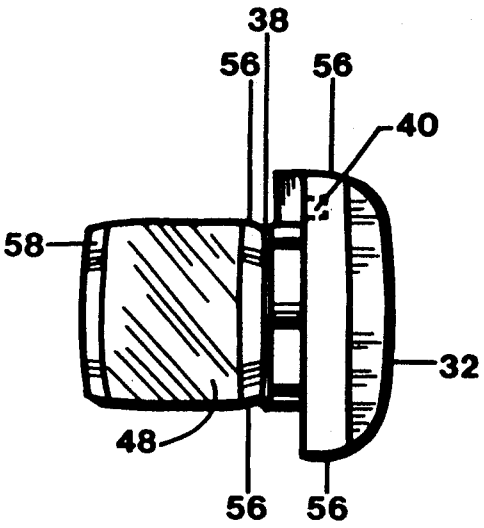
FIG. 2 is a side elevation view of the interchangeable tip detached from the receiving housing.
Figure 3:
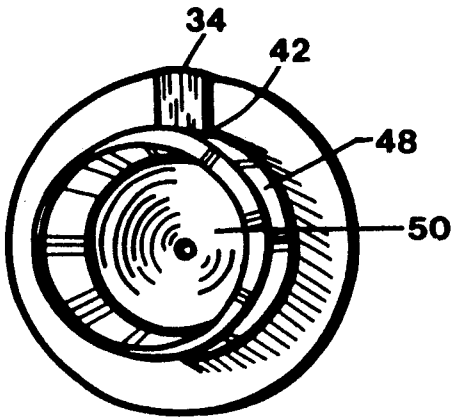
FIG. 3 is an interior elevation view of the interchangeable tip detached from the receiving housing.
Figure 9:
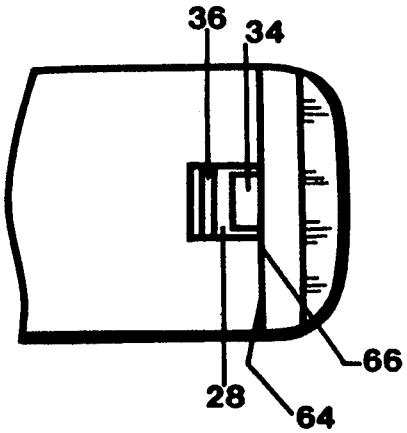
FIG. 9 is a top elevation view of my invention while in the closed position.

FIG. 9 demonstrates this interlocking position while further illustrating the relationship of the outside circumference of the receiving housing, FIG. 9-64, against the backside circumference of the interchangeable tip, FIG. 9-66. This creates a solid contact while working even when the weight is removed. The key, FIG. 1-34, of the interchangeable tip, FIG. 2, is equipped with a round steel dowel, FIG. 2-40, which is press-fitted into the backside of the tip face, FIG. 3-42, is rounded in contour with the sleeve, FIG. 2-48. The end of the aforementioned sleeve is slightly tapered, FIG. 2-58, for easy assembly into the receiving housing, FIG. 4-22.

Removal of the interchangeable tip, FIG. 2, occurs when an appropriate prying tool such as a nail is placed into the key slot, FIG. 1-28, pushed down, and pulled back. To ensure the best leverage possible, the key slot, FIG. 1-28, is conveniently placed at the top of the hammer's poll, FIG. 1-30. Either the weight, FIG. 5, may be exchanged or removed, or the tip, FIG. 2, exchanged for a different-surfaced face, FIG. 1-32. In the rare case of mushrooming, the receiving housing, FIG. 4-44, and weight, FIG. 5-46, are equipped with a rounded relief to prevent the siezing of the tip or weight respectively.

Figure 6:
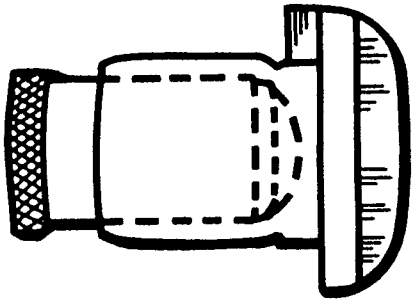
FIG. 6 is a side elevation view of the relationship of the interchangeable tip and interchangeable weight in ghost.
Figure 5:
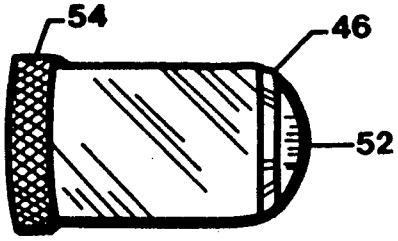
FIG. 5 is a side elevation view of the interchangeable weight detached from the interchangeable tip.
Figure 8:
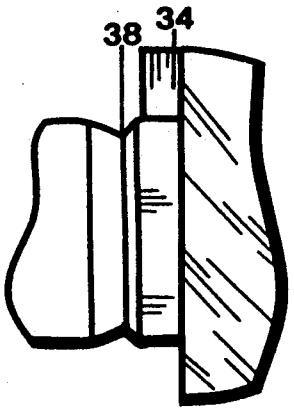
FIG. 8 is an enlargement of the section taken through FIG. 2 by section lines 56.
Figure 7:
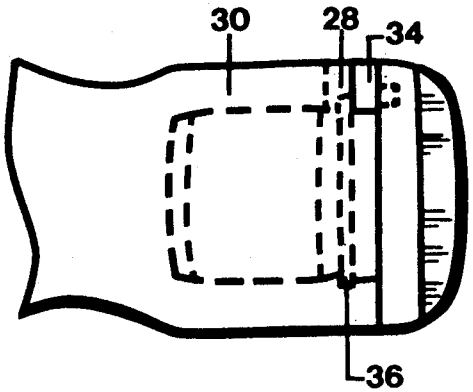
FIG. 7 is an isometric side view of the interchangeable tip in ghost within the receiving housing.

The tip is designed to house the weight, FIG. 6. This is possible by boring and reaming the steel shaft of the tip to form a sleeve with a conically-shaped interior, FIG. 3-50. This allows the bullet-shaped nose of the weight, FIG. 5-52, to seat itself, FIG. 6. The backside of the weight is knurled, FIG. 5-54, for easy grasping and removal from the tip.

By employing the "annealing" process to temper the steel, the tapered groove and back edge of the tip were "chamfered". This tapering permits simple replacement of the tip into the receiving housing.

The components of my invention may be "hot" or "dropped" forged using a blank of steel material then "heat-treated" or "tempered" using the "annealing" process. High carbon steel is preferred and most widely used.

While the above description contains many specifities, these should not be construed as limitations on the scope of the invention, but rather as an exemplification of the one preferred embodiment thereof. Many other variations are possible.

Accordingly, the scope of the invention should be determined not by the embodiment illustrated, but by the appended claims and their legal equivalents.

What is claimed is:

1. A hammer comprised of a head and a handle interconnected thereto: said head formed with an open-ended hollow interior receiving housing equipped with a circumferential groove which receives and holds a retainer ring and at said head's forward striking end, a detachable and interchangeable tip is designed with a tapered groove to interlock with said retainer ring and a key which guides said tip within a key slot which is cut from the poll of said head thereby holding said tip within said receiving housing, said tip has a hollow interior to carry a predetermined interchangeable weight when necessary, said weight, when in place, bottoms out within said receiving housing as said tapered groove of said tip interlocks with said retainer ring.

2. A hammer comprised of a head and a handle interconnected thereto: said head formed with an open-ended hollow interior receiving housing equipped with a circumferential groove which receives and holds a retainer ring and at said head's forward striking end, a detachable and interchangeable tip is designed with a tapered groove to interlock with said retainer ring and a key which guides said tip within a key slot which is cut from the poll of said head thereby holding said tip within said receiving housing, said tip solidly formed bottoms out within said receiving housing as said tapered groove of said tip interlocks with said retainer ring.

* * * * *